US006279767B1

(12) United States Patent
Yoon

(10) Patent No.: US 6,279,767 B1
(45) Date of Patent: Aug. 28, 2001

(54) CONTAINER WITH AN INCREASED DOOR OPENING HEIGHT

(75) Inventor: Ji-Young Yoon, Inchon (KR)

(73) Assignee: Jindo Co., Limited, Seoul (KR)

( * ) Notice: Subject to any disclaimer, the term of this patent is extended or adjusted under 35 U.S.C. 154(b) by 0 days.

(21) Appl. No.: 09/392,223

(22) Filed: Sep. 9, 1999

Related U.S. Application Data

(63) Continuation-in-part of application No. 08/859,255, filed on May 20, 1997, now abandoned.

(51) Int. Cl.[7] ..... B65D 88/00
(52) U.S. Cl. ..... 220/1.5
(58) Field of Search ..... 220/1.5

(56) References Cited

U.S. PATENT DOCUMENTS

| | | | | |
|---|---|---|---|---|
| 3,972,437 | * | 8/1976 | Lovich et al. | 220/1.5 |
| 4,854,460 | * | 8/1989 | Josephs | 220/1.5 |
| 4,995,522 | * | 2/1991 | Barr | 220/1.5 |
| 5,601,201 | * | 2/1997 | Looker | 220/1.5 |

OTHER PUBLICATIONS

Inernational Standard, ISO 668, Fifth edition, 1995, 12–15, Series 1 freight containers—Classification, dimensions and ratings.

* cited by examiner

*Primary Examiner*—Joseph M. Moy
(74) *Attorney, Agent, or Firm*—Staas & Halsey LLp

(57) ABSTRACT

It is an object of the present invention to provide a container with an increased door opening height in which the thickness of the door header is reduced and the floor of the base structure is sloped downward towards the doorway, thereby increasing the efficiency with which palletized cargoes can be loaded and the effective capacity of the container while maintaining the container's external dimensions and structural integrity. A container with an increased door opening height which comprises a rear end frame including a door sill disposed at the rear side of a base structure, corner posts disposed extending upward from both ends of the door sill, a door header spanning the width of the container disposed on the tops of the corner posts, corner fittings disposed at the points where the corner posts are connected to the door header and the door sill, and an door mounted on the corner posts, wherein while the external dimensions of the container are maintained, the thickness of the door header is reduced and the floor of the base structure slopes downward towards the doorway, so that the door opening height from the top surface of the door sill to the bottom surface of the door header is increased.

4 Claims, 9 Drawing Sheets

CONTAINER WITH AN INCREASED DOOR OPENING HEIGHT

CROSS REFERENCE TO RELATED APPLICATION

This application is a continuation-in-part of U.S. application Ser. No. 08/859,255, filed May 20, 1997 now ABN.

BACKGROUND OF THE INVENTION

1. FIELD OF THE INVENTION

The present invention relates to a container, and more specifically, to a freight container with an increased door opening height in which the thickness of the door header is reduced without changing the external dimensions of the freight container's rear end frame. Moreover, the floor slopes downward towards the doorway in order to increase the height of the door opening, thereby increasing the effective capacity of the freight container and the efficiency with which it can be loaded.

2. DESCRIPTION OF THE RELATED ART

Freight containers are used to hold freight while it is being transported by land, sea or air. Their widespread use on ships, planes, trucks, and trains requires that they be made to withstand the rigor of travel, while also conforming to international standards of dimension so that they are compatible with such a spectrum of transport vehicles, for example, the various dimensions identified by the International Standard ISO 668, fifth edition, Dec. 15, 1995, the contents of which are hereby incorporated by a reference. One such example of a prior art freight container conforming to the International Standard ISO 668 is a Series 1A freight container which has a minimum door opening dimensions of 2.134 m×2.286 m, external dimensions of 12.192 m×2.438 m×2.438 m, an internal volume of 1 $m^3$ and minimum internal dimensions of (the nominal container external height—241mm)×2.330m×11.998m. The door opening dimensions of the freight containers are particularly important factors affecting the efficiency with which freight can be loaded and unloaded.

The prior art will be now explained in detail with reference to FIG. 1, which is a perspective view of a conventional freight container, and FIG. 2, which is a perspective view illustrating the freight container in FIG. 1 from another angle. The framing of a conventional freight container 1 is hexahedral in shape. The front end frame 20 and rear end frame 30 are disposed on a base structure 10 and are connected to each other by an upper frame 40 and a lower frame 50. A plurality of panels are arranged on the top and sides of this hexahedral skeleton to form a roof 3 and side walls 5, respectively.

FIG. 3 is an exploded perspective view illustrating the structure of the rear end frame of a conventional freight container, and FIG. 4 is a front view illustrating the rear side of a conventional freight container, and FIG. 5 is a schematic side c ross-sectional view illustrating the base structure of a conventional freight container.

The rear end frame 30 of the conventional freight container 1 includes a door sill 32, which serves as a threshold at the rear side of the base structure 10, and a corner post 34 disposed on each end of the door sill 32. On the tops of the corner post 34 is mounted a door header 36. Corner fittings 38 are provided at each point where the corner posts 34 are jointed to the door header 36 and the door sill 32. The hinges 65 connect each door 60 to its respective corner post 34 so that a given end door 60 is rotated on its hinges 65 to a fixed angle when the door 60 is opened.

As shown in FIG. 5, the base structure 10 includes a plurality of floor bearers 12 spanning the width of the freight container and a floor 14, which is also connected to the door sill 32, mounted thereon in such a way that it is level with the door sill 32. In the freight container 1 configured as above the door opening height, measured as the distance between the top surface of the door sill 32 and the bottom surface of the door header 36, is affected by the thickness of the door sill 32 and door header 36. If the thickness of the respective door sill 32 or door header 36 is increased, the door opening height is decreased to that extent.

On the other hand, the thickness of the roof 3 is thinner than that of the door header 36, and therefore the internal height of the freight container, measured as the distance between the top surface of the floor 14 and the under surface of the roof 3, is greater than the door opening height. Therefore, even though a palletized cargo of the appropriate height is sized to fit inside the freight container, it would not be able to be loaded through the doorway due to the relatively low door opening height. Accordingly, the size of palletized cargoes to be loaded into the freight container is restricted by the door opening height, wasting space at the top of the freight container.

SUMMARY OF THE INVENTION

It is an object of the present invention to provide a freight container with an increased door opening height in which the thickness of the door header is reduced and the floor of the base structure is sloped downward towards the doorway, thereby increasing the efficiency with which palletized cargoes can be loaded and the effective capacity of the freight container while maintaining the freight container's external dimensions and structural integrity.

In order to achieve the above object the present invention is constructed as follows: The inventive freight container's rear end frame includes a door sill disposed at the rear side of the freight container's base structure, a corner post disposed at each end of the door sill and extending upward therefrom, a door header disposed at the tops of the corner post and spanning the width of the rear end frame, corner fittings disposed at the point where the corner posts are connected to the door sill and the door header, and a door mounted on each of the corner posts with hinges. Additionally, reinforcements are fitted to the inner corners where the corner posts of the rear end frame join the door header.

The base structure of the freight container comprises a floor which is connected to the door sill and a plurality of floor bearers. The floor bearers are fitted to the bottom surface of the floor in such a manner that the space between an adjacent pair decreases with their proximity to the doorway. The respective heights of the floor bearers also decrease accordingly so as to slope the floor, which rests on top of them, downward towards the doorway.

Furthermore, in order to seal the gap between the outer surface of the end door and the inner surface formed by the door sill, the corner posts, door header, and the reinforcements, a door seal gasket is fitted to the edge of the door, and on each one side of the corner fittings is formed chamfering so as to not interfere with the door seal gasket.

BRIEF DESCRIPTION OF THE ATTACHED DRAWINGS

In accompanying drawings.

DETAILED DESCRIPTION OF THE PREFERRED EMBODIMENT

Figure 1:
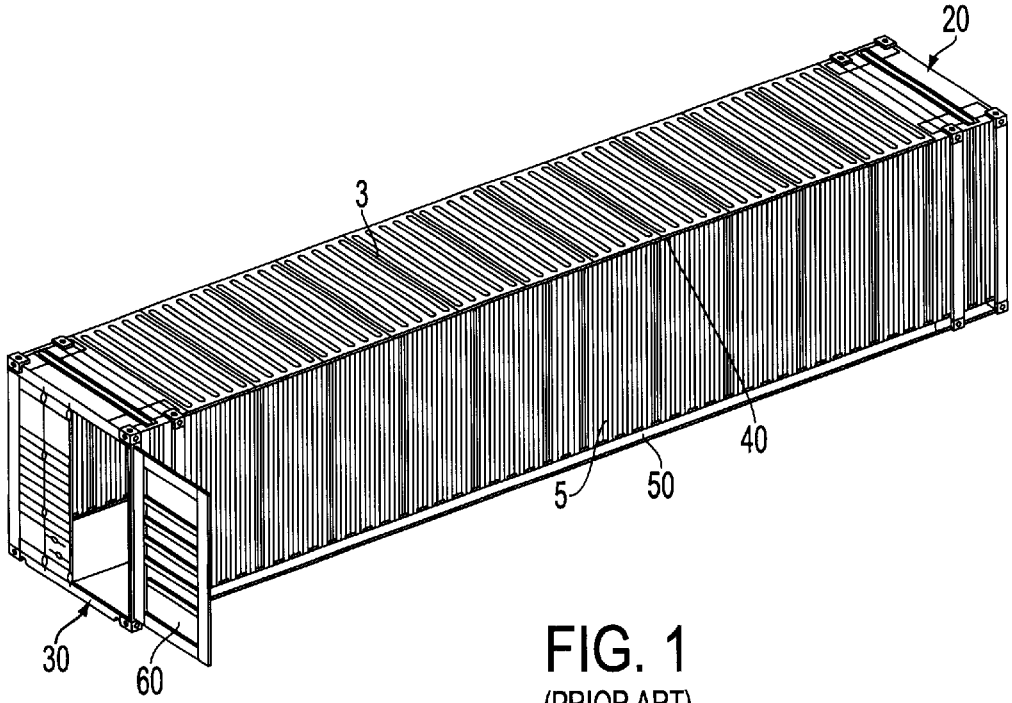
FIG. 1 (PRIOR ART)
FIG. 1 is a perspective view of a freight container according to a prior art.
Figure 2:
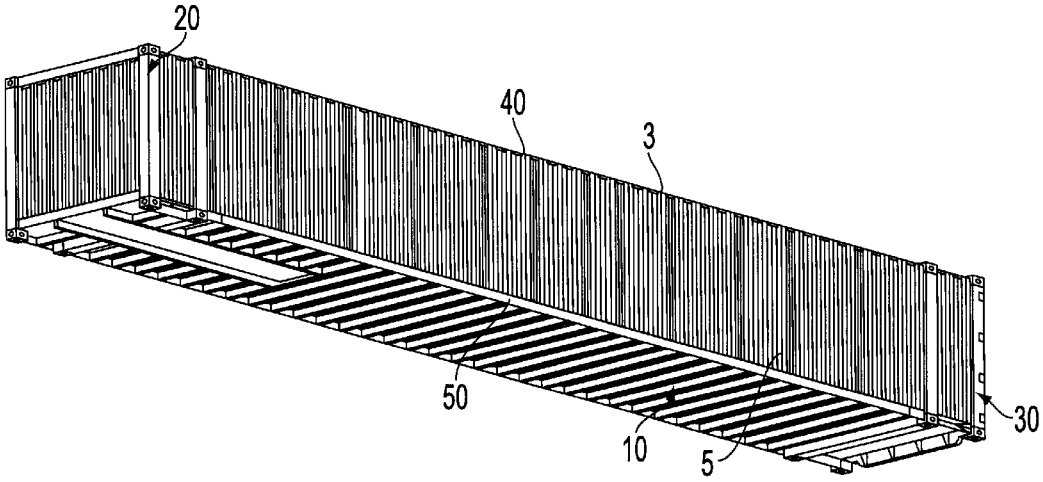
FIG. 2 (PRIOR ART)
FIG. 2 is a perspective view illustrating the freight container of FIG. 1 from another angle.
Figure 3:
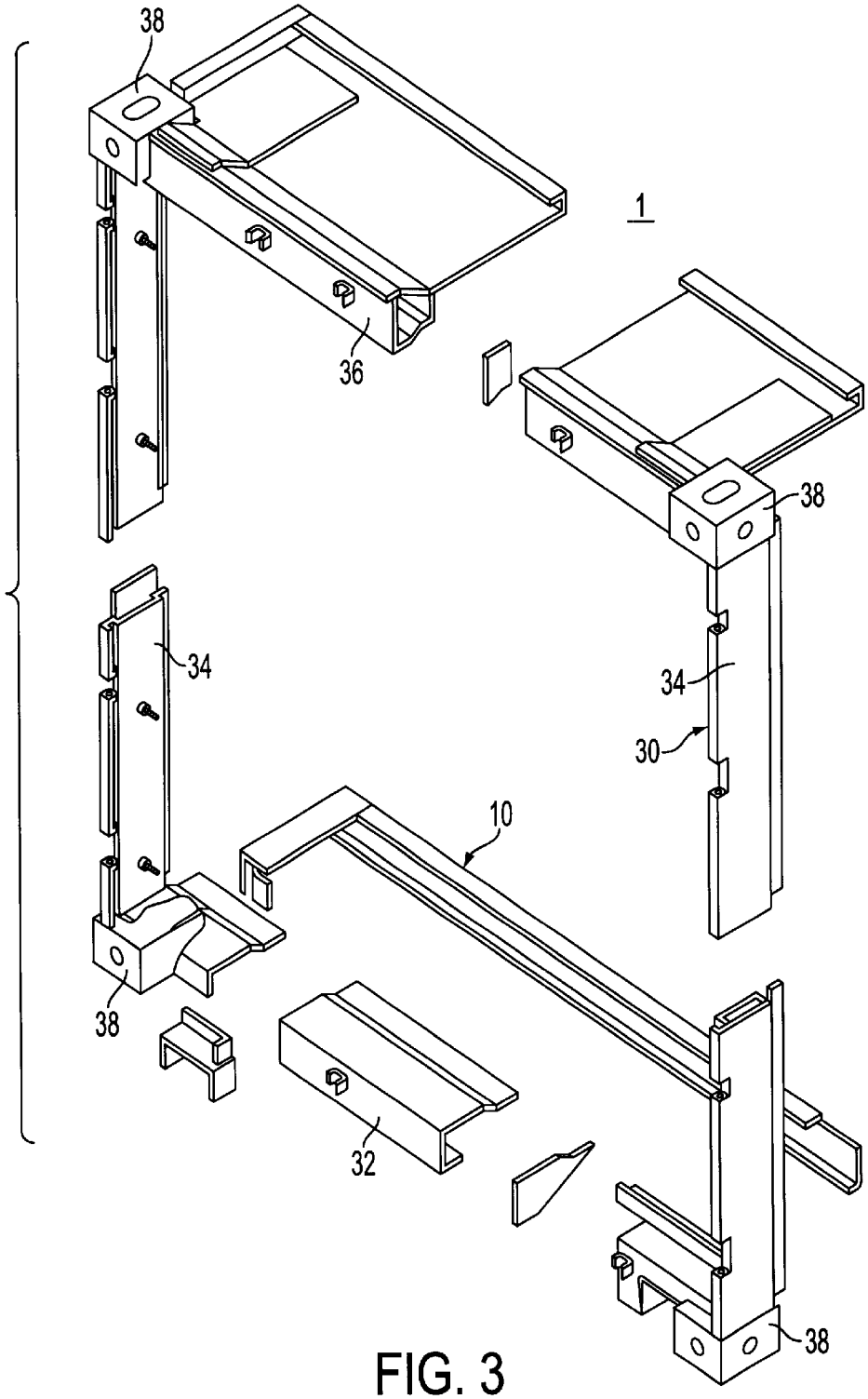
FIG. 3 (PRIOR ART)
FIG. 3 is an exploded perspective view illustrating the structure of the rear end frame in a prior art freight container.
Figure 4:
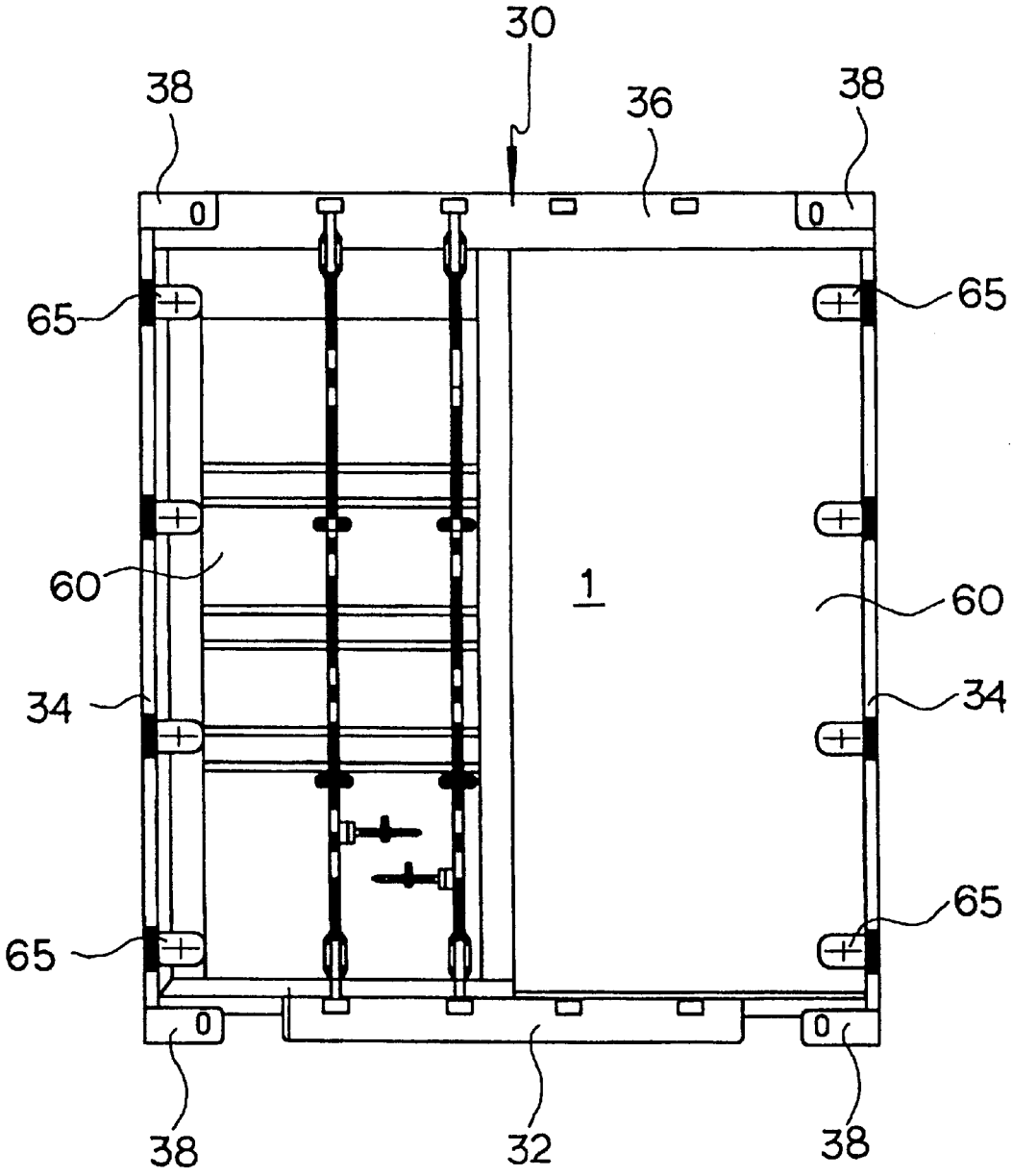
FIG. 4 (PRIOR ART)
FIG. 4 is a front view illustrating the rear side of a prior art freight container.
Figure 5:
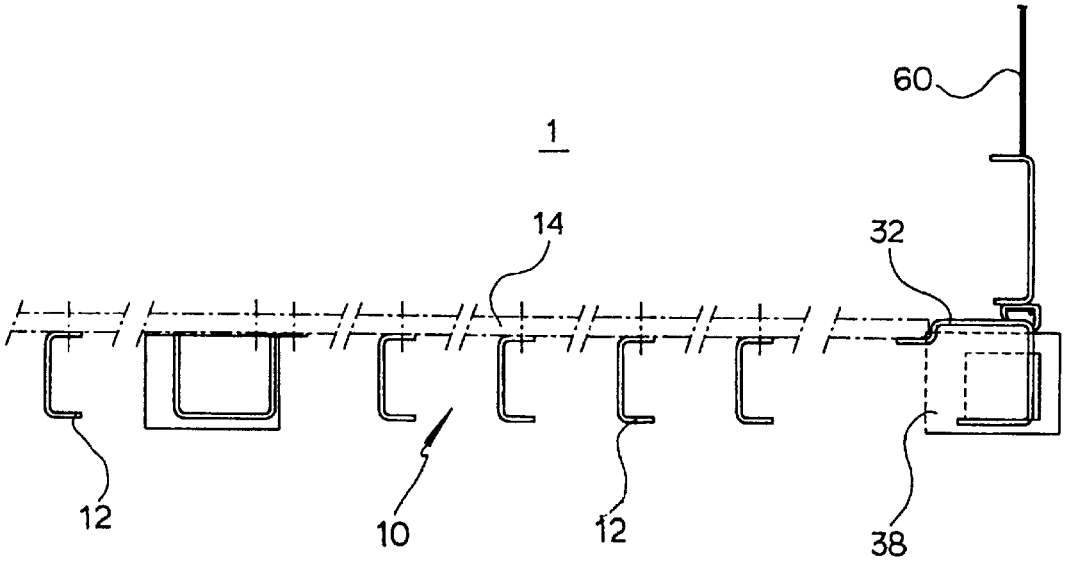
FIG. 5 (PRIOR ART)
FIG. 5 is a schematic side cross-sectional view illustrating the base structure of a prior art freight container.

The preferred embodiment of the present invention will be now described in detail referring to the attached drawings. The same reference numerals used to describe features in FIGS. 1–5 will be used in the drawings of the present invention as well.

Figure 6:
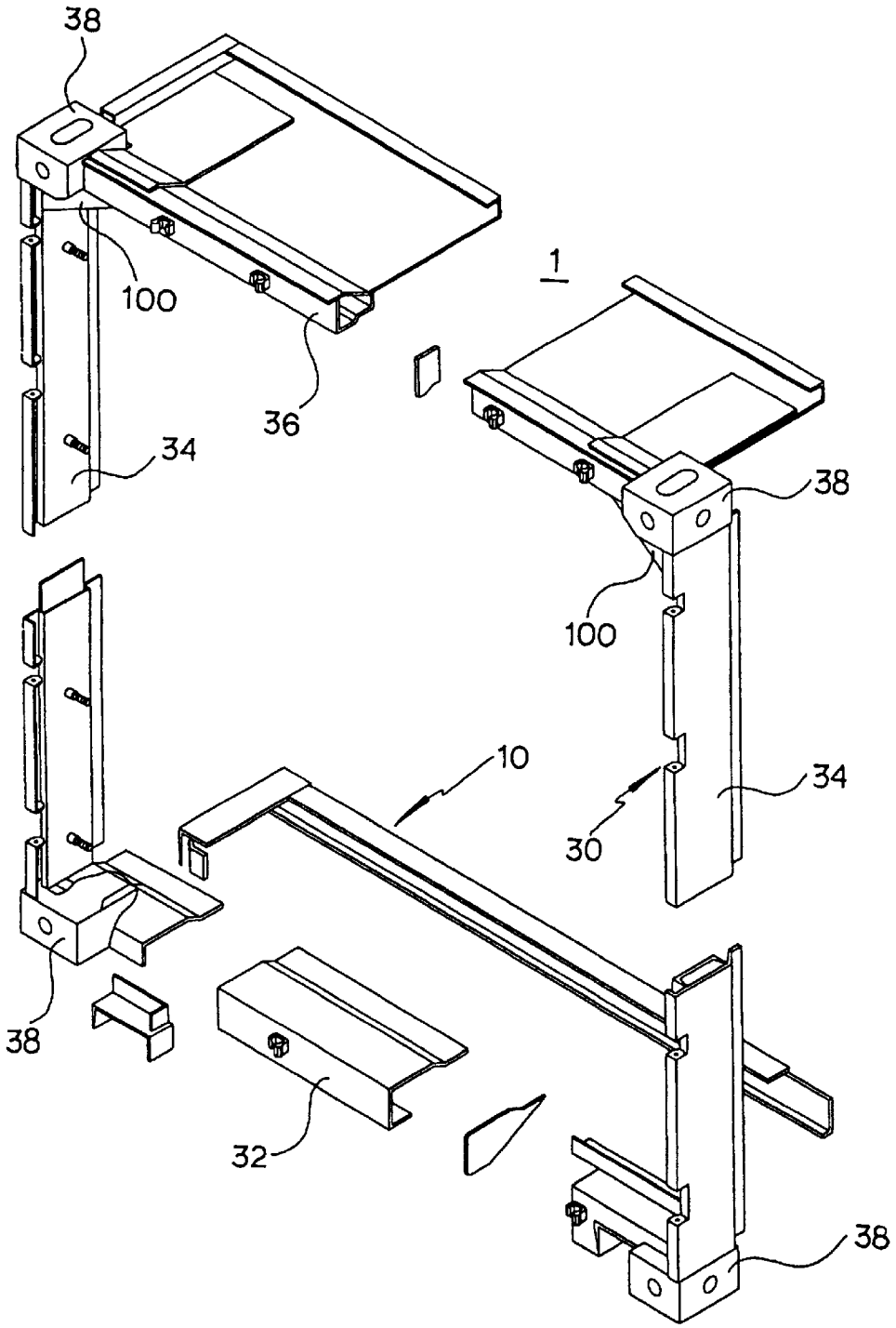
FIG. 6 is an exploded perspective view illustrating the structure of the rear end frame with an increased doorway height according to the present invention.
Figure 7:
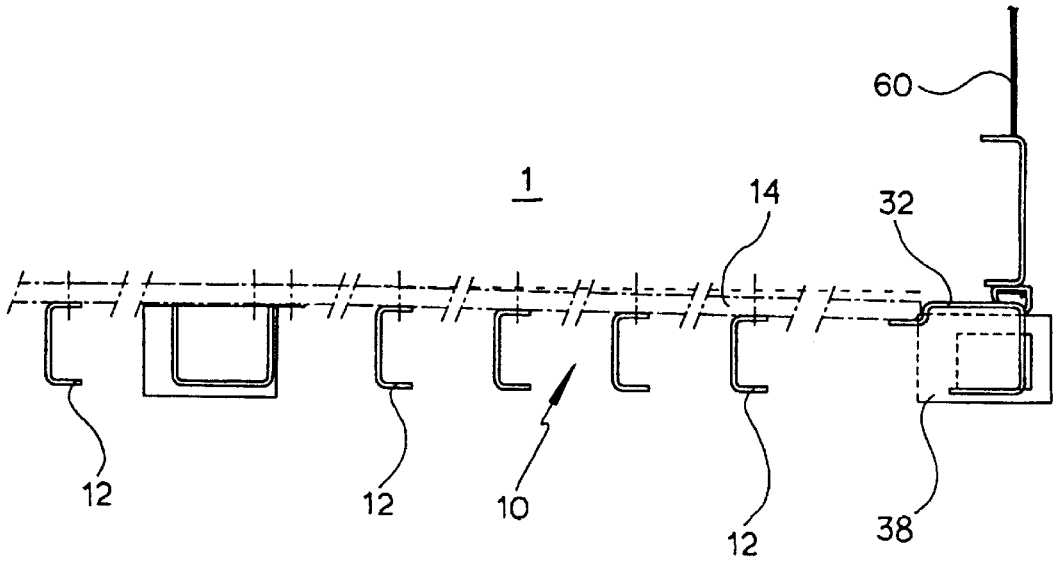
FIG. 7 is a schematic side cross-sectional view illustrating the base structure of the freight container in FIG. 5 according to the present invention.

FIG. 6 is an exploded perspective view illustrating the structure of the inventive freight container's rear end frame with an increased doorway height and FIG. 7 is a schematic side cross-sectional view illustrating the base structure of the inventive freight container.

A door sill 32 is disposed at the rear side of a base structure 10 and a corner post 34 extends upward from each side of the door sill 32. A door header 36 spanning the width of the freight container is disposed on tops of the corner posts 34 and corner fittings 38 are disposed at the points where the corner posts 34 is connected to the door sill 32 and the door header 36.

As the features of the present invention, the thickness of the door header 36 is reduced and the floor 14 of the base structure 10 slopes downwards towards the doorway, so that the door opening height (measured from the top surface of the door sill 32 to the bottom surface of the door header 36) is increased while the external dimensions of the freight container 1 are not changed.

The thickness of the door header 36 is decreased so that the door opening height increases as much as the difference between the thickness of the inventive door header 36 and that of the conventional door header. The bottom portion of the freight container 1 is configured so that the floor 14, mounted on the top portion of the base structure 10, slopes downward toward the doorway from approximately halfway into the freight container 1 so that the door opening height increases as much as the floor is depressed adjacent to the door sill 32. The floor 14 is supported by a plurality of floor bearers 12 mounted laterally underneath the floor 14. The floor bearers 12 are arranged so that the space between any two adjacent floor bearers 12 and any one floor bearer's height both decreases with their proximity to the door sill 32. The heights of the floor bearers 12 decrease according to the slope of the floor 14 and are arranged so that the bottom surfaces of the floor bearers 12 lie in the same plane. The decreased interval between adjacent floor bearers 12 serves to compensate for the reduced contribution the thinner floor bearers 12 make to the structural integrity of the freight container 1.

Figure 8:
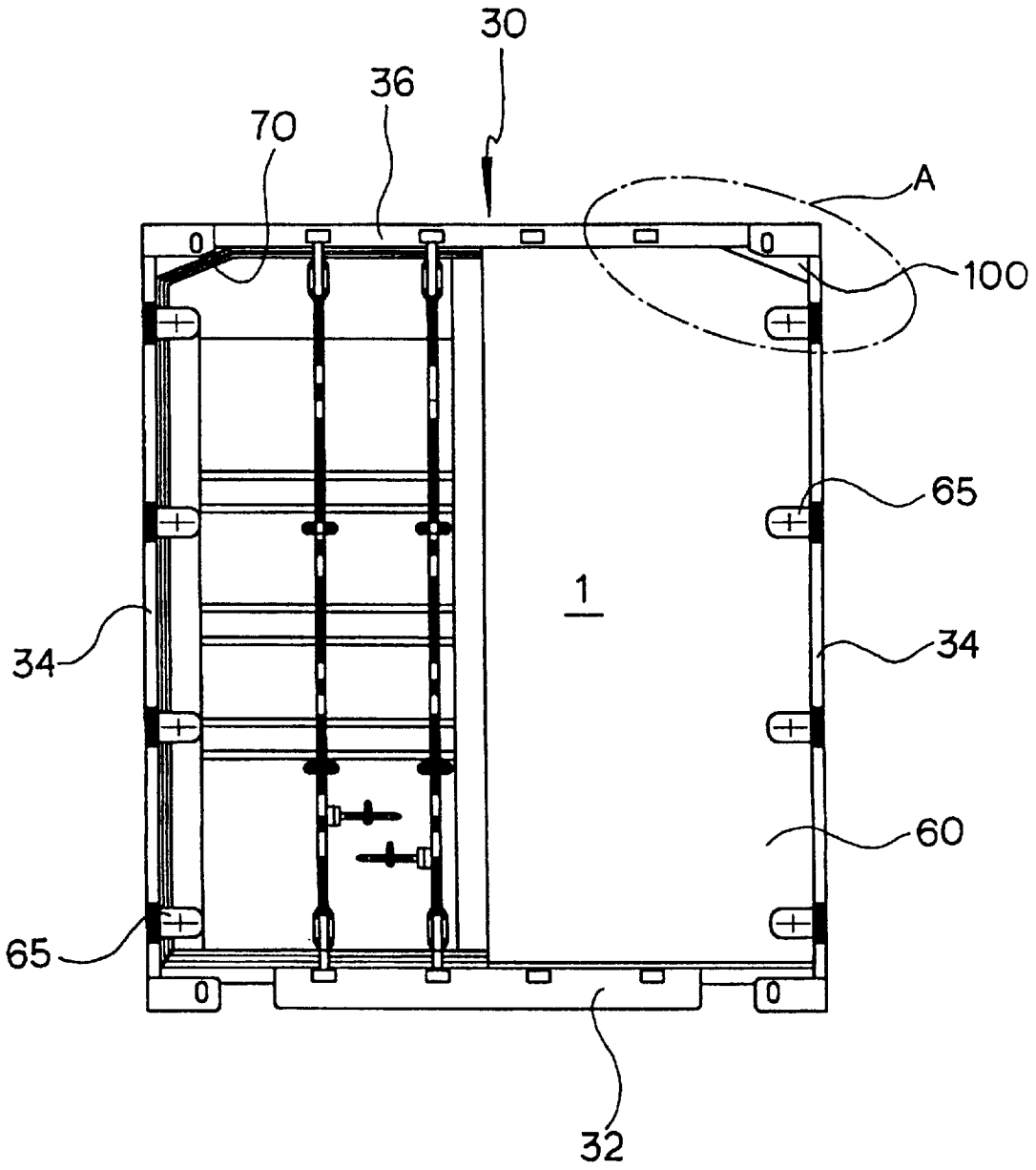
FIG. 8 is a front view illustrating the rear side of the freight container in FIG. 4 according to the present invention.
Figure 9:
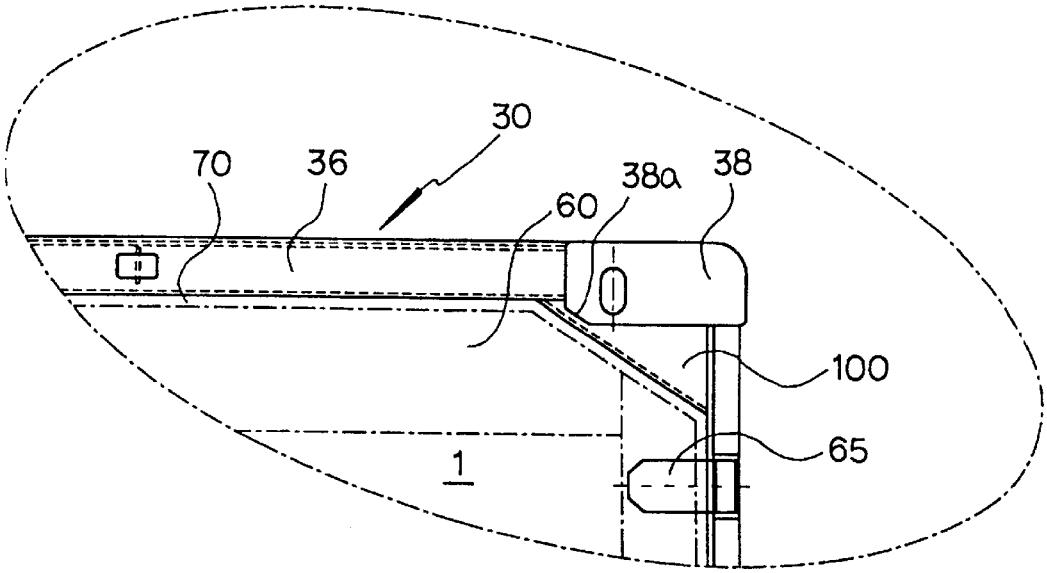
FIG. 9 is an expanded view illustrating the region "A" in FIG. 8.

FIG. 8 is a front view illustrating the rear side of the inventive freight container and FIG. 9 is an expanded view illustrating the region "A" in FIG. 8.

To further reinforce the weakened structure of the freight container 1 due to the previously-discussed thinner door header 36, reinforcements 100 are provided at the points where the corner posts 34 and the door header 36 are connected. Each reinforcement 100 is shaped as a right-triangle and is fitted into the corner formed by the corner posts 34 and the door header 36, so that the two sides of the reinforcement 100 making a right angle are attached to the door header 36 and the door post 34, respectively.

The reinforcements 100 do not place restrictions on the height of the door opening, but the upper corner of the end of the door 60 is somewhat restricted depending on the dimension of the reinforcement 100. Therefore, the upper corner of the end of the door 60 is formed to correspond to the hypotenuse of the reinforcement 100.

In order to seal the gap formed between the outer surface of the end of the door 60 and each surface of the door sill 32, the door post 34, the door header 36 and the reinforcement 100, a door seal gasket 70 is provided on the edge of the end door 60. Further, in order to prevent the door seal gasket 70 from interfering with the cornel fittings 38 when the end door 60 is opened or closed, a chamfering 38a is formed on the inner corner of each corner fitting 38. The chamfering 38a is formed so that the cut line parallels the hypotenuse of the reinforcement 100.

As described above, the present invention is constructed so that the thickness of the door header 36 is decreased and the floor 14 of the base structure 10 slopes downwards towards the doorway, so that the internal height of the rear end frame 30 can be increased while the external dimensions of the freight container are maintained.

On the other hand, because the strength of the upper and lower portions of the doorway is weakened in proportion with the thickness that the door header 36 is reduced, any way to strengthen the weakened strength must be provided so that the strength tests according to "ISO 1496" which provides regulations for an international standard of the freight container should be satisfied.

In such a freight container with an increased doorway, the difference between the internal height and the door opening height is smaller than that of the conventional freight container, and therefore the design of palletized cargoes to be loaded becomes very easy, and much more of the cargoes can be loaded in the freight container 1.

As described above, the inventive freight container is constructed so that the thickness of the door header is reduced while the external dimensions of the freight container are maintained and the floor of the base structure slopes downward towards the doorway so that the internal height of the doorway is increased, thereby increasing the effective capacity of the freight container and the efficiency with which it can be loaded.

What is claimed is:

1. In a container for shipping cargo by at least one of trains, ships, and trucks being configured to adhere to a plurality of predetermined standard external dimensions for conventional freight containers, having a rear end frame including a door sill disposed at a rear side of a base structure, corner posts having tops extending upward from both ends of said door sill, a door header spanning the width of the container disposed on the tops of said corner posts, corner fittings disposed at points where said corner posts are connected to said door header and said door sill, giving said container a predetermined structural integrity and a door mounted on said corner posts, the improvement comprising:

an enlarged door opening, greater than a predetermined door opening, said enlarged door opening formed by reducing a thickness of said door header and sloping a floor of said base structure downward towards the door, thereby increasing a height of the door opening from the top surface of said door sill to the bottom surface of said door header while maintaining the predetermined standard external dimensions of the container, and by adding corner reinforcement attached to said header and corner posts to maintain said predetermined structural integrity.

2. The container according to claim 1, wherein a plurality of floor bearers fitted to a bottom surface of said base structure in such a manner that a space between two adjacent floor bearers decreases with increasing proximity to the door.

3. The container according to claim 2, wherein a height of any given one of said plurality of floor bearers is formed to conform to the downward sloping of said floor while maintaining a plane created by said floor bearer's collective bottom surfaces.

4. The container according to claim 2, wherein a height of said floor bearers is formed to conform to the downward sloping of said floor while maintaining a plane created by said floor bearers' collective bottom surface in order to seal a gap between an outer surface of said door and an inner surface formed by said door sill, said corner posts, said door header and said reinforcements, wherein a door seal gasket is fitted to an edge of said door, and on each one side of said corner fittings is formed chamfering to prevent said door seal gasket from interfering with said corner fittings.

* * * * *